United States Patent [19]

Daugherty et al.

[11] 4,441,487

[45] Apr. 10, 1984

[54] COSMETIC AND THERAPEUTIC APPLIANCE

[75] Inventors: Carol A. Daugherty, Washington; Larry N. Siebens, Whippany; Ronald R. Daugherty, Washington, all of N.J.

[73] Assignee: R. D. Design Co., Inc., Washington, N.J.

[21] Appl. No.: 273,364

[22] Filed: Jun. 15, 1981

[51] Int. Cl.[3] ..... A61H 21/00

[52] U.S. Cl. ..... 128/24.2; 128/65; 132/73

[58] Field of Search ..... 128/24.1, 24.2, 24.5, 128/381, 399, 400, 403, 362; 132/73, 73.5, 73.6; D28/56, 41

[56] References Cited

U.S. PATENT DOCUMENTS

| | | | |
|---|---|---|---|
| D. 118,830 | 2/1940 | Newman | 132/73 X |
| 2,148,661 | 2/1939 | Thierer | 128/24.2 |
| 2,169,990 | 8/1939 | Preve | 132/73 |
| 2,198,989 | 4/1940 | Cooley | 128/399 X |
| 2,580,981 | 1/1952 | Webster | 132/73 |
| 2,644,446 | 7/1953 | Viniegra | 440/59 |
| 3,055,357 | 9/1962 | Redka | 128/25 B |
| 3,298,368 | 1/1967 | Charos | 604/291 |
| 3,323,517 | 6/1967 | Keller | 128/24.1 |
| 3,939,825 | 2/1976 | Krummenacher | 128/52 |
| 3,965,495 | 6/1976 | McNair | 4/622 |

*Primary Examiner*—Richard J. Apley
*Assistant Examiner*—David J. Brown
*Attorney, Agent, or Firm*—Martha G. Pugh

[57] ABSTRACT

Method and apparatus are disclosed for massaging and otherwise treating the hands, more specifically the nails and cuticles. A uniquely contoured hollow handrest of shell-like configuration which comfortably supports either hand with the fingers in outstretched, separate positions, is centered in a shallow container of treating oil. The inner periphery of the container includes a semi-annular barrier of oil-soaked sponge against which the fingernails and cuticles rest, and means for heating the oil above room temperature. The handrest is constructed to include a vibrator adjacent to its inner surface. Thus, the fingers and nails of a hand under treatment may be simultaneously soaked in hot oil and massaged with vibrations.

9 Claims, 5 Drawing Figures

COSMETIC AND THERAPEUTIC APPLIANCE

BACKGROUND OF THE INVENTION

This relates in general to a method and apparatus for the therapeutic and cosmetic treatment of the hands, and more particularly to manicure treatment of the fingernails and cuticles.

Vibratory massage to various parts of the body is well-known to induce relaxation and other beneficial effects, such as stimulation of the circulation. In addition, it is well-known that heat treatment of the skin, particularly of the hands, nails and cuticles, with various types of ointments has beneficial long-term effects in maintaining the skin soft and pliable, and also has beneficial short-term effects in softening the nails and cuticles to a condition in which they are more readily treated by a manicure operator.

Various types of devices have been provided in the prior-art for performing these functions singly, or in concert. However, for the most part, the devices provided to perform these functions are apparatus of such a size and/or shape, that they are not adapted for the mass consumer market.

Accordingly, it is the principal object of the present invention to provide an improved method and apparatus adapted for simultaneously applying vibratory and hot oil treatment to the hands for therapeutic and/or cosmetic benefit.

A more particular object of the invention is to provide a compact, aesthetically pleasing device which is adapted to perform massage and hot oil treatment to the hands prior to a manicure.

Another object of the invention is to provide a device which is relatively inexpensive to fabricate and safe to operate.

A further object of the invention is to provide a device which is interchangeably adapted to service either of the hands with equal comfort.

The foregoing objects are achieved in accordance with the present invention in a device comprising a handrest of convex hollow configuration which is contoured to support either hand with outstretched fingers in a shallow container of warm oil, around the inner periphery of which, in contact with the fingertips, is a semi-annular oil-soaked sponge. A mechanism is housed inside of the hollow handrest to impose vibrations thereon at a controlled intensity or frequency. A heater disposed adjacent the inner periphery of the container maintains the oil at the desired temperature.

A particular feature of the device of the present invention is that it is compact, safe and easy to control, and comfortable and relaxing for the user.

These, and other object, features, and advantages will be readily understood from a detailed study of the invention hereinafter with reference to the attached drawings.

SHORT DESCRIPTION OF THE DRAWINGS

DETAILED DESCRIPTION OF THE INVENTION

Figure 1:
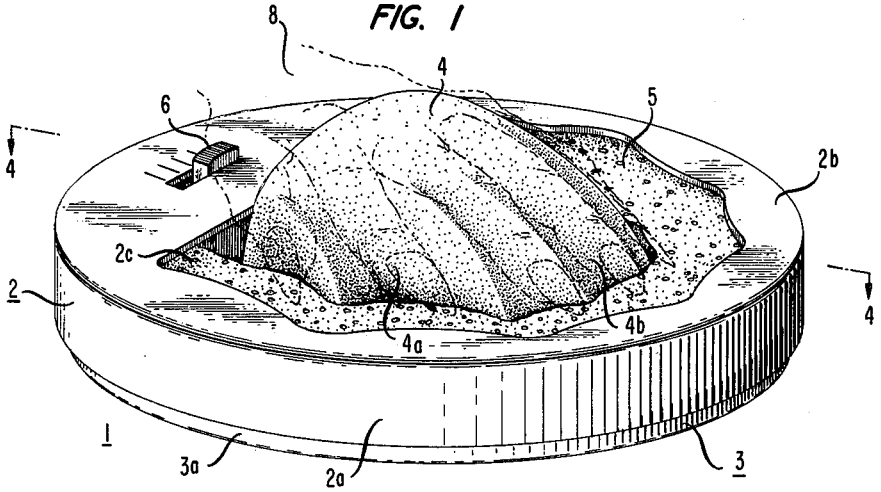
FIG. 1 is a perspective view of the hot oil and vibratory manicure apparatus of the present invention with a hand, shown in phantom, resting on the handrest.
Figure 3:
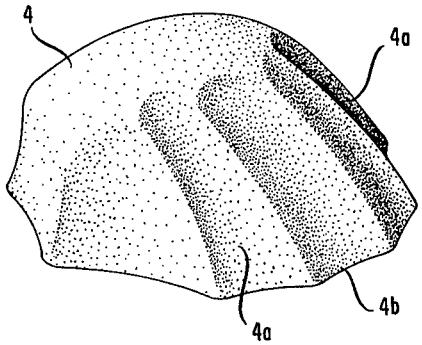
FIG. 3 is a perspective showing of the handrest removed from the combination of FIG. 1.

Referring to FIG. 1, there is shown, in perspective, the hot oil and vibratory manicure apparatus 1 of the present invention. In the present embodiment, this comprises a shallow dish 3 of a rigid thermoplastic, such as for example, polystyrene, 7 9/16 inches in outer diameter, with a wall thickness of 3/23 inch. The cylindrical outer sidewall **3*a*, extends upward to an overall height of 1 5/16 inch, in normal relation above the base. A cover 2, also formed of similar plastic material, has an overall diameter of 7¾ inches and a wall thickness of 3/32 inch. A skirt 2*a*, which depends ⅞ inch in normal relation to the top of cover 2, is constructed to fit tightly in telescoping relation over the top edge of the sidewall 3*a* of dish 3. The top face 2*b* of cover 2, is roughly annular in form, having a large central opening 2*c*, which has a straight edge 4⅞ inches across, which is centered approximately 2½ inches from the rear edge of cover 2. The opening 2*c* is 4 11/16 inches from back to front, measured from the center of the straight edge, the inner perimeter of 2*c* being slightly irregular to substantially match the grooves in the surface of handrest 4, which is shown in FIG. 3** removed from the combination.

The handrest 4, which in preferred form is moulded in a hollow shell-like shape from polystyrene, or like thermoplastic material, has an overall cross-sectional dimension in the horizontal plane of 3⅞ inches, an overall height of 2.200 inches from the plane of its base to the zenith of its curvature, and a wall thickness of approximately 3/32 inch. The handrest 4 is shaped to accommodate either a right or a left hand, under treatment. The top is substantially smooth and rounded in convex fashion to accommodate the palm of either hand, whereas the rounded sidewalls are grooved or fluted except for the back, which is substantially smooth. The wide grooves **4*a* are directed toward the front, forming substantially equal and opposite angles with the principal axis of symmetry, each having an overall width between ridges of about 1½ inches. Three narrower grooves 4*b*, each about 1 inch wide, disposed between the wide grooves 4*a***, are designed to accommodate the outstretched fingers.

The opening **2*c* is so designed that when the handrest 4 is in place, together with the dish 3 and cover 2, there is clearance of about 1 inch between the centers of grooves 4*a* and 4*b* and the slightly irregular periphery of the opening 2*c***, to accommodate the thumb and fingers of a hand positioned for treatment.

A strip of sponge material 5 about 1½ inches wide and 1¼ inch thick, is interposed around the periphery of the dish 2, which contains a therapeutic treating oil, consisting essentially, for example, of mineral oil, which is contained in dish 3 to a depth of, say, ¼ inch. In the present illustrative embodiment, about 8–10 ounces of oil are used. This tends to be partially soaked up by the sponge strip 5 which tends to rest against the fingers and nails of the hand under treatment.

Figure 2:
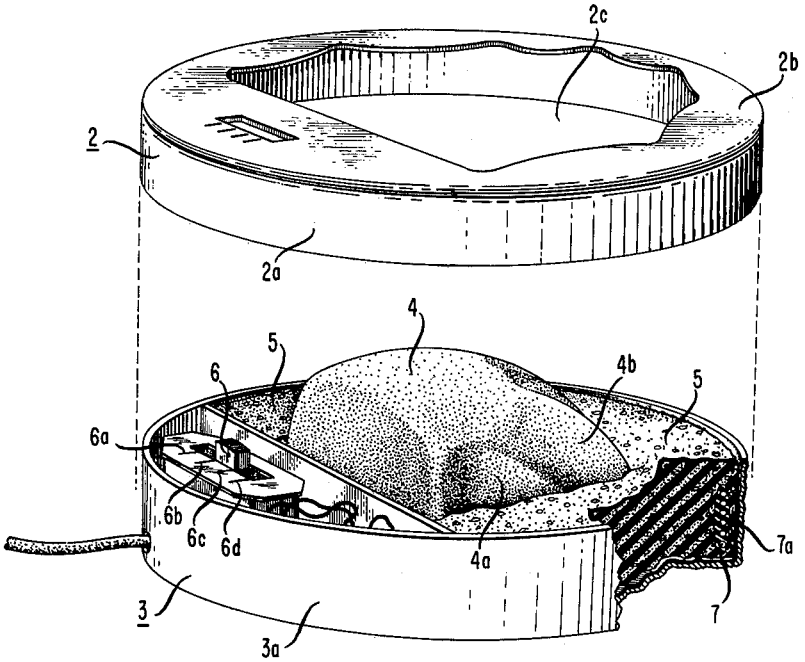
FIG. 2 is a perspective view of the manicure apparatus of FIG. 1 with the upper cover removed, a portion of the container being broken away to show the interior.
Figure 4:
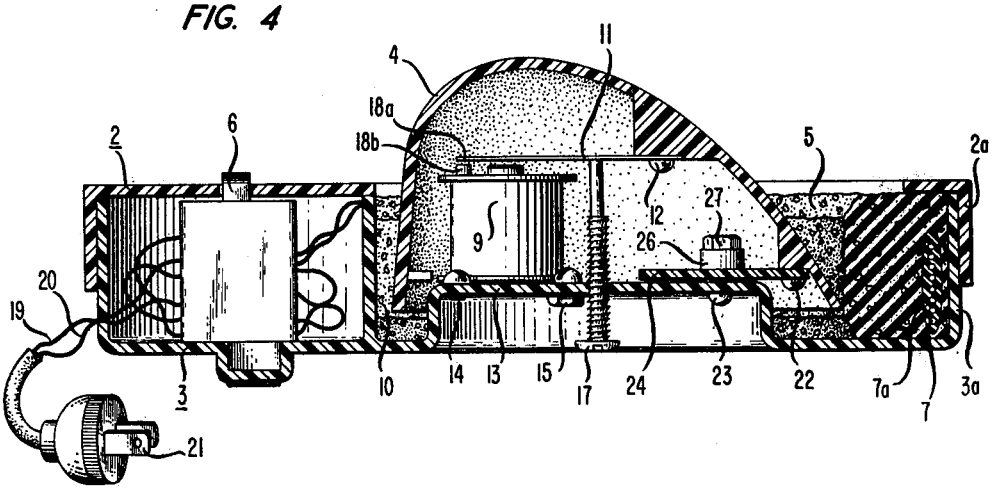
FIG. 4 is a section taken along the plane indicated by the arrows 4—4 of FIG. 1 showing the interior of the apparatus.
Figure 5:
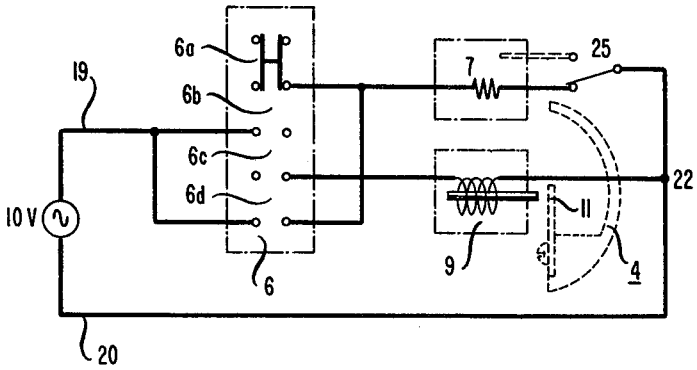
FIG. 5 is a circuit schematic of the apparatus of FIGS. 1–3.

FIGS. 4 and 5 are, respectively, a diametrical section of the interior, and the electrical circuit schematic of the combination shown in FIGS. 1 and 2. The heater 7 comprises loops of material of high electrical resistivity, say of the order of 100 ohm centimeters at 20 degrees centigrade, such as Nichrome wire, electrically and thermally insulated from each other by one or more strips of mica or similar material. The entire heater is enclosed in a sleeve 7*a* of electrically insulative and thermally conductive material, such as, for example, synthetic rubber. The heater 7, as assembled, is approximately ½ inch wide, 3/32 inch thick and 12 inches long. This is connected between the conductors 19 and 20 leading to a conventional 60 herz, 110 volt alternating-current source, into which the male plug 21 is adapted to be connected. In the present embodiment, it is contemplated that the heater 7 will have a dissipating power of approximately 800 watts, sufficient to heat 8–10 ounces of mineral oil to a temperature of, say, 120 degrees Fahrenheit. (In an alternative configuration, a heater of approximately 1200 watts will be used in conjunction with a switching thermostat in order to reduce the time required to heat the oil supply, and yet prohibit overheating of the oil). As a further alternative, a conventional thermostat 25 is connected in series with heater coil 7 to keep the heater below a preselected temperature.

It will be understood that instead of a conventional AC source the circuit can alternatively be modified in a manner well-known in the art to include a different type of vibrator to enable it to be energized by a battery; and that a transformer may be interposed into the circuit to either step-down or step-up the voltage from the source, or to transform the current from AC to DC, if necessary to the optimum operation of the device.

Connected in parallel with the heater resistance 7 is an electromagnetic vibrator of any of the types well-known in the art. In the present example, this is adapted to be operated across a conventional 110 volts, 60 herz, alternating-current source, to produce 60 vibrations per second. This is carried out by a conventional vibrator mechanism comprising a electromagnet 9 fastened by means of a pair of bolts 14 and 15 to the supporting base 13, which is 1 inch in diameter, and substantially centered in an area raised ⅝ inch above the peripheral base portion of container 3.

The vibrator includes a leaf-spring 11 of a ferromagnetic material such as, say, spring steel, which is rigidly connected at one end by a bolt 12 to a projection on the underside of hollow handrest 4. In operation, the leaf-spring 11 is alternately attracted and repulsed from the electromagnet as the current reverses phase at a rate of 60 times per second. The resulting vibration is transmitted through the leaf-spring to the handrest 4.

Adjustment of the amplitude of vibrations is provided by the bolt or post 17 [which rides freely in sleeve 17*a*] which protrudes through the center of base 13 and rests against leaf spring 11. Adjustment of bolt 17 adjusts the gap between leaf spring 11 and electromagnet 9 to vary the intensity of vibrations imparted to handrest 4.

A flat plate 24, of plastic, such as polystyrene, is rigidly secured by a bolt 22 to a second internal projection near the lower open end of hollow handrest 4. It will be understood that in the alternative, plate 24 can be formed integrally with handrest 4. The handrest 4 is attached to the shallow dish 3 by means of a screw or bolt 23 which is interposed through the plate 24 a few inches from its inner end, the bolt being secured at its upper end by a nut 27 which is tightened against a rubber grommet 26. The purpose of the latter is to dampen transmission of vibrations between handrest 4 and shallow dish 3.

The four-way switch 6 is connected in series with power leads 19, which in the present embodiment is coupled with the oppositely poled power lead 20 in a connecting cable leading to the conventional male plug 21 which is adapted to be connected to a 60-herz 110 volt AC source. Lead 20 is connected to junction 22 between the heater resistance 7 and the coil 9, whose opposite terminals are respectively connected to position 6*b* and 6*c* of switch 6. The four-way switch 6 has a first open circuit position 6*a*, which is closed to "off". The second position, 6*b* connects power lead 19 to heater 7. In this position of the switch 6, the vibrator coil 9 remains open circuited. In the third position 6*c*, lead 19 is connected to vibrator coil 9, while the heater 7 remains disconnected. In the fourth position 6*d*, lead 19 is connected in parallel to heater 7 and vibrator coil 9.

Thus, the combination of the present invention serves as a device for simultaneously providing relaxing vibrations and warm oil treatment to the outstretched hand of the user. The ends of the fingers are in contact with the oil-soaked sponge to soften the nails and cuticles for a subsequent manicure or other treatment. Each hand may be treated, using the same apparatus.

It will be understood that the present invention is not limited to the particular structure described herein by way of example, but only by the scope of the appended claims.

What is claimed is:

1. An apparatus for hand treatment which comprises in combination:

A shallow container constructed to hold a quantity of treating oil therein and having a top edge surface, a bottom surface and peripheral wall surfaces having a central opening therein;

A handrest, said handrest being formed of substantially rigid material contoured in a convex curvature on its upper side, and substantially hollow on its underside, said convex curvature shaped to accomodate a hand for treatment with the fingers in outstretched separated positions so that the palm rests near the zenith of said curvature and the fingers depend against the sides with their respective ends near the lower periphery of said handrest;

said handrest being disposed in said central opening, the inner peripheral wall of said container being spread-apart from the outer periphery of said handrest and forming a semi-annular gap therebetween and said zenith of said curvature extending above said top surface;

a strip of sponge disposed in said gap to at least partially surround said inner peripheral wall of said container and being slightly spaced apart from the outer periphery of said handrest to accomodate the ends of the fingers of said treated hand in contact with said sponge;

means comprising an electrical heater disposed in heat transfer relation to said container for heating said oil to a temperature above room temperature;

vibrator means coupled to the hollow underside of said handrest and constructed to impose a vibratory motion on said handrest; and electrical circuit means connectable in energy transfer relation between said heater and said vibrator means and a source of power for energizing said heater and said vibrator.

2. The combination in accordance with claim 1 wherein said handrest comprises a substantially rigid thermoplastic or like material.

3. The combination in accordance with claim 1 wherein the surface of said handrest is substantially smooth near the zenith of said curvature, the lateral surface thereof being formed to include a series of elongated downwardly extended grooves having inwardly curved cross-sections to accommodate the thumb and fingers of the treated hand.

4. The combination in accordance with claim 3 wherein said elongated downwardly extending grooves include a pair of grooves, each of a width to accommodate the outstretched thumbs of a hand under treatment, the grooves of said pair being directed toward the front of said handrest in substantially equal and opposite directions from its principal axis of symmetry, and a plurality of narrower grooves therebetween, each of a width to accommodate the outstretched fingers of a hand under treatment.

5. The combination in accordance with claim 1 wherein said electrical heater comprises insulated wire having a resistivity of the order of 100 ohm-centimeters at 20 degrees centigrade, disposed adjacent to a portion of the inner periphery of said container.

6. The combination in accordance with claim 1 wherein said vibrator means includes in cooperating relation:

an electromagnet connected to be energized by said electrical circuit means when connected to a source of power:

a ferromagnetic spring-biased arm rigidly connected at one of its ends to the underside of said handrest;

said spring-biased ferromagnetic arm, responsive to energization of said electromagnet, being alternately attracted and repulsed as the alternating current reverses phase thereby imposing vibrations on said handrest.

7. The combination in accordance with claim 6 wherein said vibrator means includes adjustment means coupled between the underside of said handrest and the ferromagnetic arm for controlling intensity of said vibrations.

8. The combination in accordance with claim 1 wherein said container is filled at least about half full of treating oil warmed to a temperature within the range 100 to 120 degrees Fahrenheit; and wherein said sponge is at least partially immersed in said warmed oil.

9. The method of therapeutically and/or cosmetically treating the hands which comprises the steps of:

placing the hand under treatment on a handrest contoured to hold the thumb and fingers in outstretched relation;

resting the tips of said fingers, including the nails and cuticles, against a strip of sponge;

immersing said fingertips and said sponge in a therapeutic oil bath maintained at a temperature within the range 100 to 120 degrees Fahrenheit; and simultaneously imposing on said handrest vibrations at a frequency within the range 50 to 60 cycles per second.

* * * * *